US005377627A

United States Patent [19]

Andersson

[11] Patent Number: 5,377,627

[45] Date of Patent: Jan. 3, 1995

[54] FLUIDIZED BED COMBUSTOR, EQUIPPED WITH MEANS FOR IMPROVING THE DISTRIBUTION OF FUEL AND GASES

[75] Inventor: Mats Andersson, Finspong, Sweden

[73] Assignee: ABB Carbon AB, Finspong, Sweden

[21] Appl. No.: 90,170

[22] PCT Filed: Jan. 14, 1992

[86] PCT No.: PCT/SE92/00016

§ 371 Date: Jul. 15, 1993

§ 102(e) Date: Jul. 15, 1993

[87] PCT Pub. No.: WO92/13237

PCT Pub. Date: Aug. 6, 1992

[30] Foreign Application Priority Data

Jan. 15, 1991 [SE] Sweden ..... 9100122

[51] Int. Cl.[6] ..... F22B 1/00

[52] U.S. Cl. ..... 122/4 D; 110/245; 422/143; 422/146

[58] Field of Search ..... 122/451; 110/245; 165/104.16; 422/139, 143, 146

[56] References Cited

U.S. PATENT DOCUMENTS 4,130,071 12/1978 Porter .
4,161,917 7/1979 Jubb .
4,429,644 2/1984 Thomas .
4,879,958 11/1989 Allen et al. ..... 110/245
5,257,585 11/1993 Sato et al. ..... 110/245

FOREIGN PATENT DOCUMENTS 0243845 5/1986 European Pat. Off. .
0321308 6/1989 European Pat. Off. .
63-14006 1/1988 Japan .
1326651 8/1973 United Kingdom .

*Primary Examiner*—Edward G. Favors

[57] ABSTRACT

Distributor device comprises at least one lower and/or one upper stationary distributor device for distribution of fuel in the form of gas and particles in a fluidized bed and is arranged above fuel feed nozzles in the bed, or at or above the upper limit of the bed. The task of the distributor device is to spread fuel, rising upwards in the bed, more evenly over a large area in the bed and to create turbulence above the bed. This is achieved by designing the distributor device with a mid-portion and upwardly-inclined wing-like members or the cone to bring about even distribution of fuel by forcing the fuel to follow an outwardly-directed horizontal or obliquely upwardly-rising flow of fuel.

22 Claims, 5 Drawing Sheets

FLUIDIZED BED COMBUSTOR, EQUIPPED WITH MEANS FOR IMPROVING THE DISTRIBUTION OF FUEL AND GASES

TECHNICAL FIELD

The present invention relates to distributor equipment for improved distribution of fuel and hence a more uniform distribution of combustion in a fluidized bed in a power plant. The intention is to achieve a higher efficiency and reduced emissions by a more efficient combustion. The invention is primarily intended to be applied to a PFBC power plant in which combustion is performed at a pressure exceeding the atmospheric pressure.

BACKGROUND OF THE INVENTION

Firing with a particulate fuel in a fluidized bed requires a good distribution of a fuel fed into the bed for a complete combustion of the particles to take place. The fuel in the bed comprises one gaseous part and one part of particles which are both capable of being blown off and not capable of being blown off.

If the number of feed points for fuel is too small, an accumulation of fuel takes place in a plume-shaped region above each individual fuel feed nozzle. In this region, all available oxygen in the fluidization air is rapidly consumed, in which case particles which have not been burnt out completely of their fuel content reach the bed surface and are blown off to a freeboard above the bed. From the freeboard the flue gases are passed on from the combustion to ash cleaners, so-called cyclones.

A problem which may arise when particles containing unburnt residues of fuel occur is that fires may arise at other locations in the plant. For example, it is known that insufficiently burnt-out particles may burn at undesired points, such as in the freeboard or in the cyclones. Solid particles and gas with still combustible constituents at these points may encounter fluidization air which still contains oxygen residues since air may have passed regions with a lower concentration of fuel, that is, between the above-mentioned plume-shaped combustion regions, during the flow upwards through the bed, this air not being depleted of oxygen by combustion.

Fires at the above-mentioned points are unacceptable and entail harmful thermal stresses on the construction material used, since an after-combustion after the bed increases the temperature of the flue gases. In addition, the composition of emissions in the flue gases may be changed in an undesired and uncontrolled manner.

Emission of nitrogen oxides may increase since the use of ammonia for reducing these oxides is rendered difficult when ammonia is burning in zones with coal combustion. Also the emission of sulphur may increase since the use of a sorbent, fed into the bed, for reducing sulphur is rendered difficult if the plume-shaped regions occur in the bed. This is due partly to the compound formed during the sulphur reduction not being stable at low oxygen contents, and partly to combustion taking place in zones where the sorbent content is lower than in the bed. Further, of course, the effective burn out of the fuel content in the particles is reduced, which reduces the efficiency of the plant.

The bed normally accomodates a tube bundle for steam generation above the fuel feed nozzles. Another problem which may arise is that fluidization air which is completely depleted of oxygen gives an increased corrosion on the tube material, which in turn leads to a rapid material wear in the tube bundle. A better distribution of the fuel leads to a reduced risk of corrosion in the plume-shaped regions since regions with a permanently low oxygen content in the fluidization air are eliminated.

A good distribution of the fuel in the bed can be achieved by the particulate fuel being supplied to the bed at a large number of feed points in the form of well distributed fuel feed nozzles, as disclosed, for example, in Swedish patent application 9000354-2.

In case of a large number of fuel feed points, an even distribution is obtained in the fluidized bed between the fuel and the fluidization air. This makes it possible for the gaseous part of the fuel and that part of the fuel which constitutes particles capable of being blown off to burn out completely before this part in the form of burnt out particles reaches the surface of the bed and is blown off.

A design with a large number of fuel feed points is costly and difficult to realize because of a complicated network of distribution conduits to the fuel feed nozzles, as well as problems if the different conduits are clogged.

Another possible solution to the mentioned problems is to arrange some form of distributor of the fuel in the bed after feeding of the fuel. The patent GB 1 326 651, for example, shows a distributor in the form of a rotating wheel provided with blades and located above a fuel feed opening. Upon rotation of the wheel, the fuel is distributed in the bed.

Using some type of movable parts to achieve a good fuel distribution in the bed is, however, not suitable. The movable parts are influenced by greatly destructive forces, such as, for example, the high temperature. In addition, the availability for service of any devices is greatly limited or disturbing for the operation of the plant.

SUMMARY OF THE INVENTION

The present invention relates to distributor equipment comprising a lower and/or an upper distributor device. The distributor device is fixedly mounted in a fluidized bed and/or at or above the upper limit of the bed in a power plant. Its task is to spread upwardly-rising fuel, in the form of gas and particles, and to distribute the fuel over a larger area and more evenly in the bed as well as to create, partly above and partly below the upper limit of the bed, turbulence of the gas and movement of the particles out towards the periphery of the bed.

The distributor device can be formed in many different ways. The design differs somewhat between the lower one, which is intended to be arranged in the bed above a fuel feed nozzle, and the upper one, which is intended to be arranged at or above the surface of the bed. The lower distributor device, which is intended to be arranged in the bed, will hereinafter be referred to as a "bed distributor", whereas the upper distributor device, which is intended to be arranged at or above the bed surface, will be referred to as a "freeboard distributor".

The distributor equipment may either comprise only the bed distributor or only the freeboard distributor, or both the bed distributor and the freeboard distributor.

Thus, the task of the bed distributor is to spread the fuel rising upwardly in the bed and to distribute it over a larger area in the bed, and at the same time to distribute the fuel more evenly in the bed. This is achieved by designing the bed distributor with a receiving mid-portion and, directed outwards from this mid-portion, a distributor part with obliquely upwardly-inclining wing-like members, hereinafter called wings, or an obliquely upwardly-directed funnel-shaped frustum of a cone, where the wing-like members or the cone or the body bring about the above mentioned distribution of the fuel by forcing the fuel to follow an outwardly-directed obliquely upwardly-rising flow of the fuel, as seen from the mid-portion. Through means of holes in the wings or in the cone, the fuel is released evenly distributed over the surface in the bed which is covered by the bed distributor.

In the simplest case the bed distributor is formed with two wings which at their respective lowest part, the base, are connected to the mid-portion. The wings are horizontal or incline upwards, and outwards, and towards their free ends, they are tapering. In addition, holes are made in each wing and distributed over the wing surface. The mid-portion is not provided with holes. The mid-portion receives bubbles, rising upwards in the bed, with contents of fluidization air, fuel gases and fuel particles. The bubbles are slowed down and distributed along the wings which together with the mid-portion prevent the bubbles from rising too rapidly and hence leave the bed with contents of partially unburnt fuel. The bubbles are guided outwards, upwards by the oblique wings and are forced to follow these until they either encounter a hole in a wing or until the bubbles in their sliding movement obliquely upwards along a wing are forced over the edge of the wing since this has a tapering shape. Because of the wing shape, its inclination and with the aid of the holes, the mentioned bubbles are distributed evenly over a larger area, thus achieving a more complete combustion of the fuel.

At their free ends, the wing tips of the bed distributor may terminate in an almost horizontal portion. The horizontal portions slow down bubbles and particles and gradually release these into the bed.

The holes in the device contribute to gas release through the respective wings over the entire surface thereof. The absence of holes in the mid-portion at the bases of the wings facilitates the start of the direction of the bubbles and reduces the risk of agglomerates of fuel particles possibly adhering to holes directly above the fuel feed nozzles at the very point where the fuel concentration is largest and the velocity of the fuel particles is lowest, which could be the case if also the mid-portion were provided with holes.

The upward inclination of the wings of the bed distributor is determined by the extent to which bubble direction is desired. Since the space between the fuel nozzles and the tube bundle, located in the bed, for steam generation is limited, the length of the wings of the bed distributor is determined by this available space and the upward inclination of the wings from the horizontal line. The width of the mid-portion and hence the bases of the wings are selected in dependence on the desired distribution for the fuel in the bed. However, a bed distributor according to the present invention must not take up too large a part of the bed area.

The exact location of the bed distributor formed with two wings should be adjustable in the horizontal direction to enable it to be placed strategically in the plume of upwardly-rising bubbles which is formed close to the fuel feed nozzles.

In alternative embodiments of the bed distributor this may be provided with downward bends or folds along the long sides of the wings. This increases the bubble-directing ability of the bed distributor and creates a space which, at times, is particle-free below the bed distributor and hence facilitates the combustion of combustible gases in the fluidized bed. The fact that the space below the bed distributor is occasionally particle free also contributes to an increased fuel distribution since the fuel can penetrate more easily further into the bed.

The design of the bed distributor is such that it captures as much fuel as possible below the widest part and then the fuel is distributed in the direction of the wings. Combustible gas and/or combustible particle are released through the holes and along the tapering edge.

The task of the freeboard distributor is, at or above the upper limit of the bed, partly to spread fuel in a horizontal direction, and partly to create turbulence. The turbulence and the horizontal movement of the particles are brought about by designing the freeboard distributor as well as the bed distributor with a distributor part with obliquely upwardly-inclined wings or an obliquely upwardly-directed cone. However, the mid-portion is replaced by a mid-section in which the bases of the wings are joined in the lowest part of the freeboard distributor. The wings of the freeboard distributor are whole and straight, that is, they have no holes and no tapering shape. The freeboard distributor is formed such that bed material and gases are transported out from the central parts of the bed towards the bed periphery while at the same time turbulence is created in the freeboard above the wings. The turbulence permits gases to be mixed such that any unburnt coal particles and gases are burnt in, or as close to the bed as possible.

The turbulent mixing also renders the use of ammonia more efficient for reduction of nitrogen oxides since burning zones in the freeboard are reduced and the ammonia is not burnt. This also applies to sorbent for reducing sulphur since the combustion is reduced in zones where the content of sorbent is lower than in the bed.

In the simplest case, the freeboard distributor as well as the bed distributor is formed by two wings, which are interconnected at the mid-section and diametrically opposite. The respective wings in the freeboard distributor incline upwards and are shaped as a roof ridge, that is, as a V turned upside-down. The roof ridge shape renders difficult the build-up of dust on the wings.

The width of the wings is chosen depending on the desired distribution for the fuel in the upper part of the bed and in the freeboard. What size to choose for the wings of the freeboard distributor depends on how great the plume problem is.

In alternative embodiments, the wings of the freeboard distributor may be bent in a transverse section. Alternatively, the wing surface is plane and provided with downward folds along the long sides of the wings with the openings of the wings facing downwards.

A suitable number of distributor devices is chosen; however, at least one distributor device is arranged above each fuel feed nozzle. Additional distributor devices are possibly arranged between those arranged above the fuel feed nozzles.

The elongated shape of the distributor device, that is, the bed distributor and the freeboard distributor, respectively, is dependent on the location of the fuel nozzles in the bed. In a conceived case with several nozzles placed in parallel with each other, good coverage is obtained of regions with a need of improved fuel distribution in the bed with distributor devices of elongated shape. In case of other configurations of fuel feed, it may be necessary to design the distributor device according to other patterns. It is possible, for example, to design a distributor device provided with only one wing. Further, the mid-portion of the distributor device may be given a conical shape with a downwardly-turned tip, where more than two wings of the designs mentioned above or below are distributed along the periphery of the cone.

As mentioned, the distributor part in the device in the form of the different variants of wings may be formed with a funnel-shaped conical part, the envelope surface of the conical part having the shape of the envelope surface of the frustum of a cone. The envelope surface of this frustum of a cone has its smallest cross section area connected to the mid-portion of the device whereas the largest cross section area is placed at a higher level. In the following, such a described frustum of a cone, utilized in the device, is referred to as a "bed cone" and a "freeboard cone", respectively.

The bed cone and the freeboard cone, respectively, exhibit a closed curve shape in a horizontal cross section, the closed curve being arbitrary but preferably circular or elliptical. To achieve the intended distribution of fuel, the bed cone is provided with holes, whereby the fuel is directed to the desired extent to the space in the bed above the distributor device.

The material in the distributor device may in its simplest form consist of steel or some steel alloy or some other metal alloy which withstands the high temperatures occurring, the greatly corrosive environment and the particle-laden surrounding. The distributor device may also be made of ceramics.

The distributor device may be cooled. The cooling is suitably performed with the aid of tubes in which cooling water is transported and which are arranged in the distributor device or on its upper or lower surface.

To further improve the effect of the present invention, more fluidization air may be supplied below the bed distributor, for example by means of additional nozzles for fluidization air below the bed distributor or by arranging nozzles for fluidization air more closely together. The additional air has two effects. On the one hand, it spreads the fuel better by the increased bubble flow along the respective directions of the wings, and on the other hand, the extra supplied fluidization air makes possible an additional combustion of combustible gas. The increased flow of fluidization air locally at one fuel feed nozzle near the bed wing may provide increased erosion in the tube bundle. This risk is reduced through the improved distribution of the bubbles by the distributor device.

The advantage of distributor equipment according to the invention is that a good fuel distribution, primarily with the aid of the bed distributor, can be achieved without an increase of the number of fuel feed points having to be made. Primarily with the aid of the freeboard distributor, the combustion upstream of the freeboard will become more efficient by the creation of turbulence and a horizontal movement of material around or below the upper limit of the bed. The freeboard distributor conducts the gases out from the center of the bed to the more oxygen-rich parts in the periphery. The advantage of controlling the combustion to take place substantially in a more oxygen-rich space is that the temperature in the freeboard and the gas turbine is kept low and that heat released in the bed is utilized in a steam cycle. The gas which passes up through the freeboard will thus have a more uniform temperature distribution. Since the gas is given a heavy turbulence, better conditions are created for the reduction of nitrogen oxide by mixing ammonia into the freeboard.

DESCRIPTION OF THE PREFERRED EMBODIMENTS

With reference to the accompanying figures, a number of embodiments of distributor equipment according to the present invention will be described.

Figure 1:
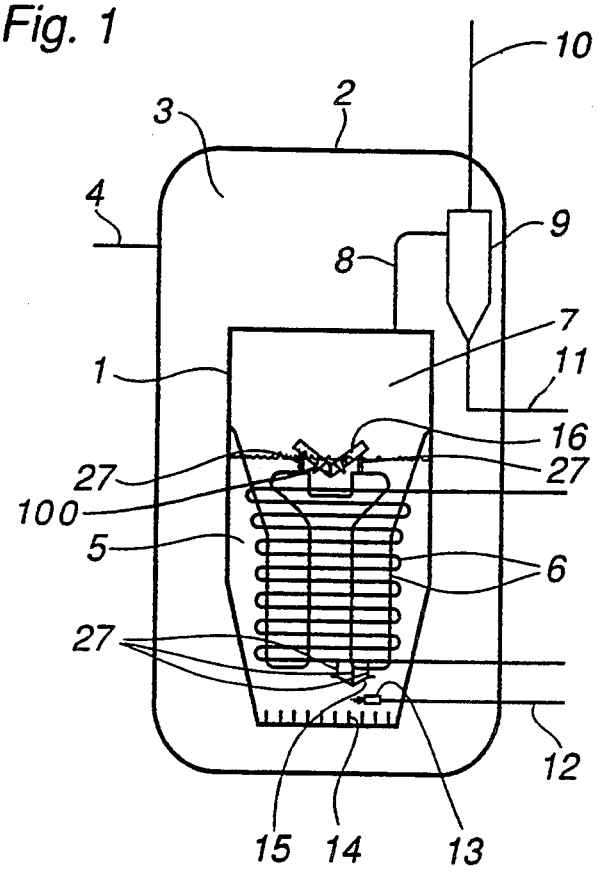
FIG. 1 shows a schematic view of the boiler part of a power plant, in which distributor equipment comprising both a bed distributor and a freeboard distributor according to the present invention is shown arranged in a fluidized bed.

FIG. 1 schematically shows a combustor 1 in a PFBC power plant, in which combustion is performed at a pressure considerably exceeding the atmospheric pressure. In the figure the combustor 1 is located inside a pressure vessel 2. The space 3 in the pressure vessel 2 outside the combustor 1 is supplied with compressed fluidization air from a compressor (not shown) via a conduit 4. The combustor 1 contains a fluidizable bed 5 of particulate material in which a fuel is burnt. In addition, the combustor 1 includes tubes 6 for generating steam for a steam turbine (not shown) and for cooling the bed 5. Flue gases leaving the bed 5 are collected in a freeboard 7 and are passed in a conduit 8 to a cleaning plant symbolized by a cyclone 9 where dust is separated, and from the cyclone 9 in a conduit 10 to a gas turbine (not shown). Separated dust is discharged from the cyclone 9 through a conduit 11. Fuel is fed into the combustor 1 via a conduit 12 and via nozzles 13. The combustor 1 is supplied with fluidization air from the space 3 via nozzles 14 for fluidization of the material in the bed 5 and for combustion of the supplied fuel.

The three main embodiments comprise arranging in the bed 5 distributor equipment comprising bed distributors 15 only or freeboard distributors 16 only, or both bed distributors 15 and freeboard distributors 16. The choice of embodiment depends on the geometry of the bed 5 and on the current plume problem The distributor device is to be cooled with water transported, for example in tubes 100 distributed on its surface.

Figure 2A:
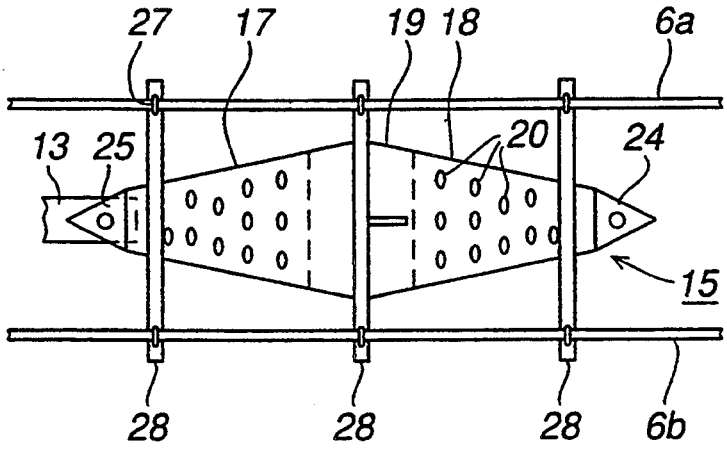
FIGS. 2*a*–2*c* show the location and attachment of a bed distributor according to the invention seen from above, from the side, and in a section along line A—A.
Figure 3A:
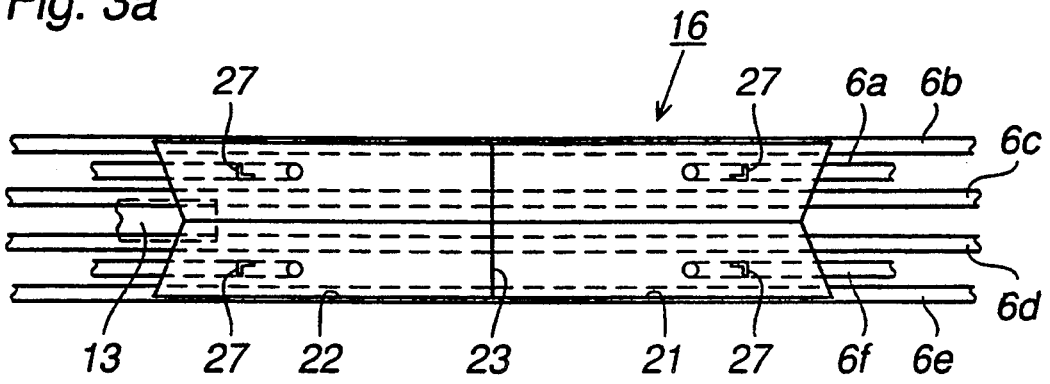
FIGS. 3*a*–3*c* shows the location and attachment of a freeboard distributor according to the present invention, seen from above, from the side, and in a section along line B—B.

FIGS. 2*a* and 3*a* show the bed distributor 15 and the freeboard distributor 16, respectively, in a view from above. The bed distributor 15 is formed with a distributor part in the form of two wings 17, 18 tapering outwardly towards their free ends, diametrically opposite to each other and with their widest and lowest parts, bases, changing into a mid-portion 19 common to both wings 17, 18. Along the wings 17, 18 of the bed distributor 15, throughholes 20 are provided. The mid-portion 19 has no holes 20. The freeboard distributor 16 on the other hand has a distributor part in the form of two whole and straight wings 21, 22, placed diametrically opposite to each other and joined in a mid-section 23. The respective wings 21, 22 of the freeboard distributor 16 are formed as the ridge of a roof, that is, as an inverted V, which efficiently renders difficult the build up of dust in the wings 21, 22 of the freeboard distributor 16.

The wings 17, 18 of the bed distributor are horizontal or incline upwards from the horizontal plane with an angle of inclination of 20° in the embodiment. A greater angle of inclination may be preferred but this creates problems with space requirement in the available space in the vertical direction within the bed 5. The wings 21, 22 of the freeboard distributor 16 are horizontal or incline upwards from the horizontal plane with an angle of inclination of between 20° and 45°, suitably 30°.

Figure 2B:
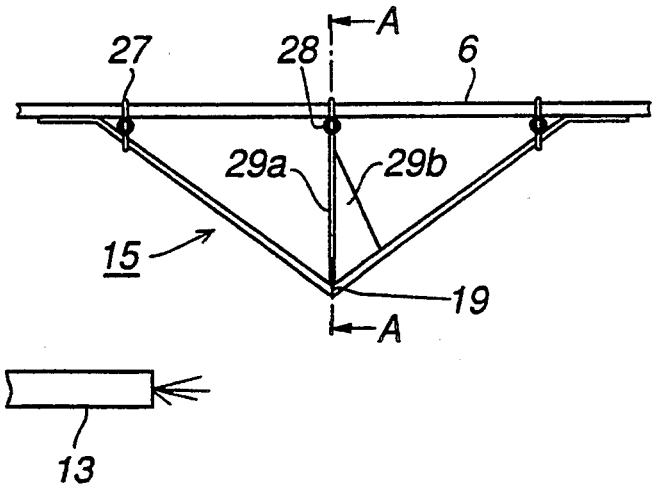
Figure 2D:
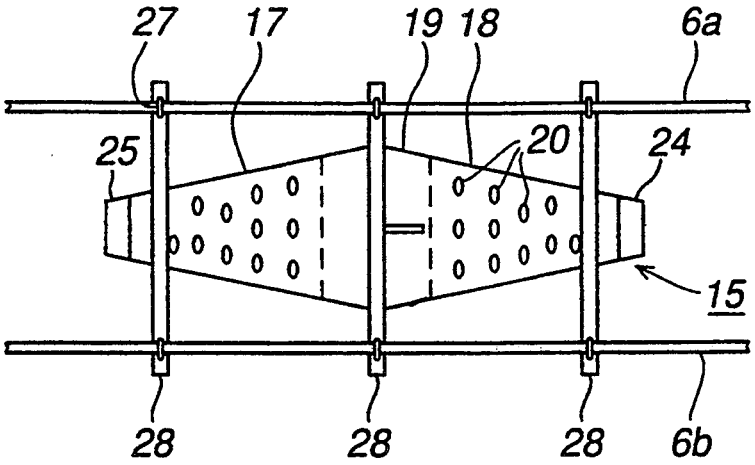
FIGS. 2*d*–2*e* show modification of the distributor shown in 2*a;*
Figure 2E:
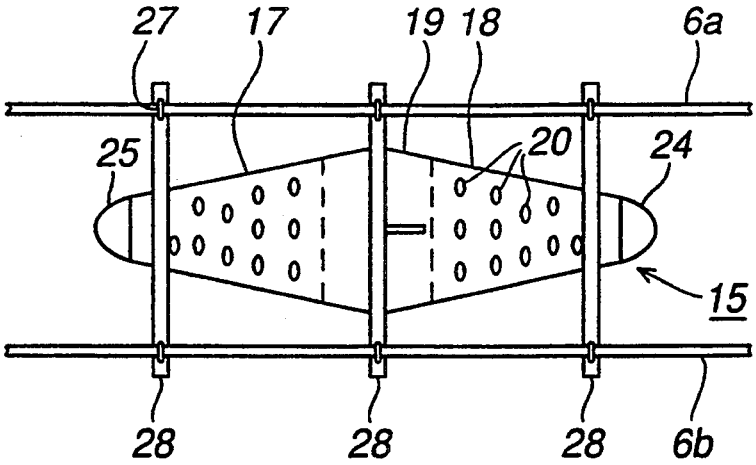
Figure 3B:
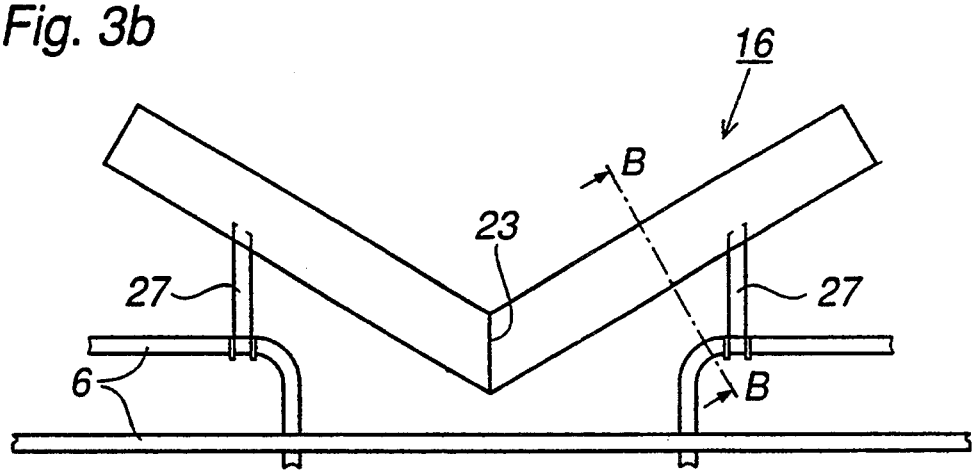

In the embodiment, FIGS. 2*b* and 3*b* show the bed distributor 15 and the freeboard distributor 16, respectively, in a view from the side. As will be clear from FIG. 2*b*, the respective free ends, tips 24, 25, of the wings 17, 18 of the bed distributor 15 exhibit a flattened out shape, which may have a horizontal extension. The tips 24, 25 may be made tapering or with a rounded or straight termination, see FIGS. 2*d* and 2*e*, whereas the wings 21, 22 of the freeboard distributor 16 are straight.

Figure 4A:
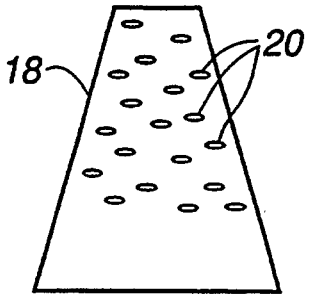
FIGS. 4*a*–4*c* illustrate different examples of the bed distributor seen in a section across the longitudinal direction.
Figure 4B:
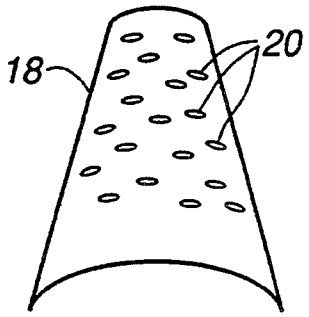
Figure 4C:
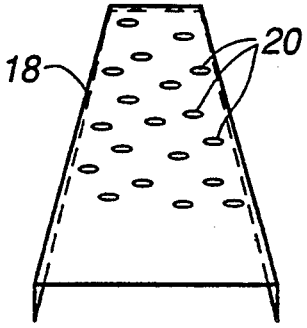
Figure 5A:
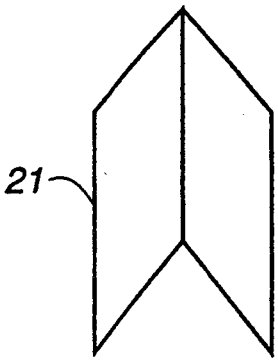
FIGS. 5*a*–5*c* illustrate different examples of the freeboard distributor seen in a section across the longitudinal direction.
Figure 5B:
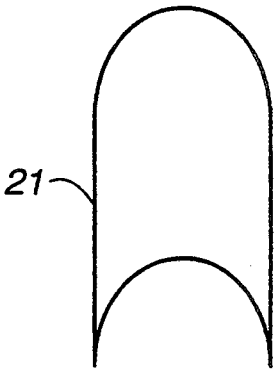
Figure 5C:
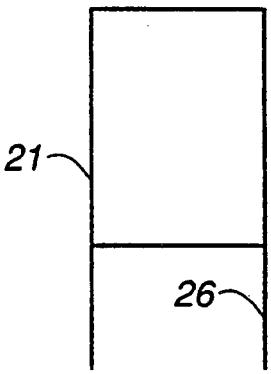

Further, FIGS. 4*a*–4*c* and 5*a*–5*c* show that the wings of the bed distributor and the freeboard distributor, 15 and 16, respectively, may be plane as in FIG. 4*a*, have a roof ridge shape as in FIG. 5*a*, or be curved in a transverse section as in FIGS. 4*b*, 5*b*. Alternatively, the wing surface may be plane but provided with downward folds 26 along the long sides of the wing according to FIGS. 4*c*, 5*c*. The task of the downward folds 26 or the curved surface of the wings with the opening downwards is to spread, in a more efficient manner, the upwardly flowing fuel particles and to make difficult the build up of dust in the wings.

FIG. 2*b* shows the location of the bed distributor 15 in relation to a fuel feed nozzle 13 with horizontal fuel supply. At a variable distance in front of the feed opening 13, the bed distributor 15 with its lowest part, the mid-portion 19, is located at a somewhat higher level than the fuel feed opening 13. The displacement in height for the bed distributor 15 is 16 cm in the example.

Figure 2C:
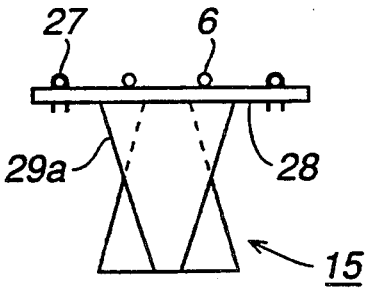

FIGS. 2*a*–2*c* illustrate the attachment of the bed wing 15 by means of holders 27 in the form of clamps, loops or the like, which surround the tubes 6. The bed distributor 15 should be displaceable in the longitudinal direction of the tubes 6 before the device is locked at the location tested. In the example, the bed distributor 15 is mounted with its lowest part 30 cm in front of the opening of a fuel feed nozzle 13, but this distance can be varied in dependence on the physical factors prevailing during the combustion.

The holders 27 are applied at bars 28, mounted across the longitudinal direction of the distributor device and with such a length that the ends of the bars 28 may bridge two parallel tube sections 6*a*–6*f*, in which the bed distributor 15 may be attached in a suspended manner. The bars 28 are attached by means of supports 29*a*, 29*b* to the bed distributor 15.

Figure 3C:
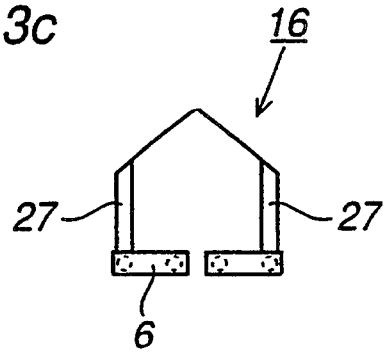

In FIGS. 3*a*–3*c* it is seen how the freeboard distributor 16 is attached in a corresponding way by means of corresponding holders 27 surrounding the tubes 6. In the example, the freeboard distributor 16 is arranged with its lowest part, that is, the mid-section 23, centrally in the bed 5.

Figure 6:
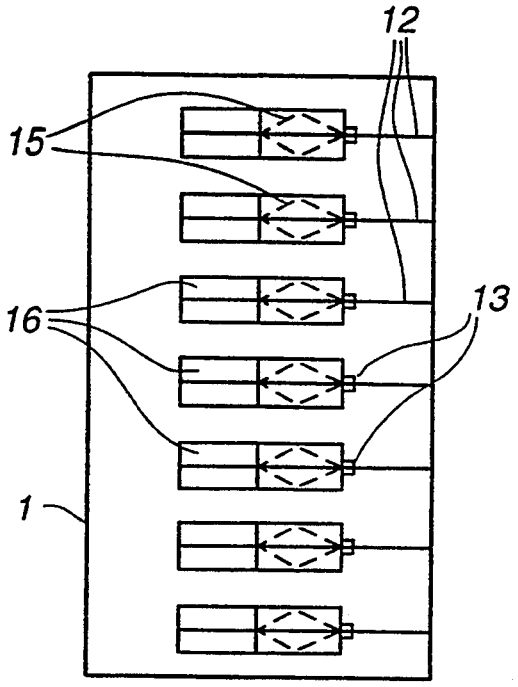
FIG. 6 schematically shows a view from above of distributor equipment comprising a plurality of bed distributors and freeboard distributors arranged in/at-/above the bed.

FIG. 6 shows the combustor 1 from above, and it is clear how the bed distributors 15 and the freeboard distributors 16, respectively, according to the invention are arranged in relation to each other.

Figure 7:
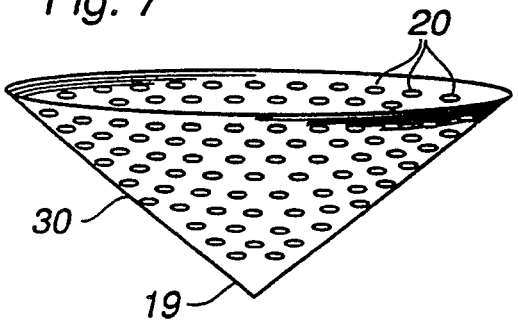
FIG. 7 illustrates a bed distributor with the distributor part made as the frustum of a cone.
Figure 7A:
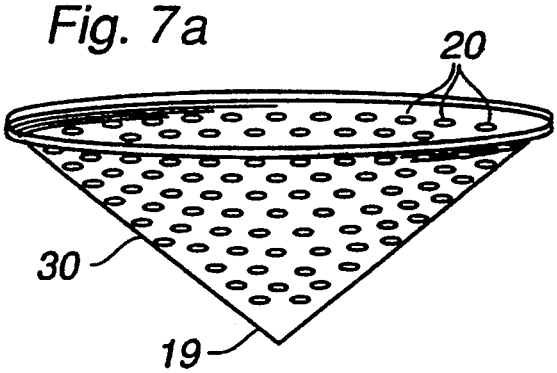
FIG. 7*a* is a modification of the cone shown in FIG. 7.

FIG. 7 shows an alternative embodiment of the invention. In this embodiment, the distributor device is made as a cone 30, a bed cone and a freeboard cone, respectively, which is attached to a mid-portion 19 which may have an arbitrary shape but is made with a conical shape in the example. Holes 20 are made in the bed cone to achieve the distribution of the fuel described above. The upward terminating edge of the bed cone and the freeboard cone, respectively, may be made with an annular flange or collar 101 to slow down fuel rising upwards along the outer side of the cone 30 (FIG. 7*a*). The bed cone and the freeboard cone, respectively, are made with circular or oval cross section.

The generatrices in the cone 30 bend outwards in their upper part, thus obtaining a flange- or collar-like termination on the upper part of the cone 30.

The distributor device may, of course, be formed as an arbitrary body or with a plurality of wings which may be distributed at arbitrary angles around the mid-portion 19 depending on the geometry of the bed 5 and the desired distribution of the fuel in the bed 5.

The nozzles for fluidization air 14 are arranged near the distributor device for the supply of additional fluidization air. This extra fluidization air is advantageously added below the distributor device arranged in the bed, that is, below the bed distributor 15 or the bed cone.

I claim:

1. A power plant comprising a combustor containing a fluidized bed together with combustible gaseous and particulate material, tubes located in the combustor for steam generation, a plurality of nozzles for supplying fluidization air which fluidizes the material in the bed and fuel feed nozzles for feeding fuel to said bed; and at least one distributor arranged above each fuel feed nozzle for spreading throughout the bed bubbles which are formed during combustion and rise upwardly;

said distributor including one distributor part with obliquely upwardly-inclined surfaces, as viewed from the horizontal plane, forming elongated, wing-like members or at least a fraction of a cone, said upwardly-inclined surfaces being arranged such that said bubbles are directed outwards along the obliquely upwardly-inclined surface and are released distributed in the bed while rising upwards;

said distributor part being provided with through-holes for fuel distribution;

said distributor including a mid-portion to which said upwardly-inclined surfaces are connected; and wherein said mid-portion is arranged in said upwardly-rising flow of bubbles above a respective fuel feed nozzle and distributes the bubbles to the distributor part.

2. A power plant according to claim 1, wherein said wing-like members are diametrically opposed, elongated and upwardly-inclined from the horizontal plane.

3. A power plant according to claim 1, wherein said wing-like members in a cross section exhibit a v-shape or a curved surface and wherein the openings face downwards.

4. A power plant according to claim 1, wherein said wing-like members have a plane shape.

5. A power plant according to claim 1, wherein said wing-like members in a cross section exhibit an inverted U-shape.

6. A power plant according to claim 1, wherein said distributor part consists of the wing-like members having free ends with a substantially horizontal extension, and wherein said free ends of the wing-like members are tapered.

7. A power plant according to claim 1, wherein said distributor part consists of the wing-like members having free ends with a substantially horizontal extension, and wherein said free ends of the wing-like members are rounded.

8. A power plant according to claim 1, wherein said distributor part consists of the wing-like members having free ends with a substantially horizontal extension, and wherein said free ends of the wing-like members have straight termination.

9. A power plant according to claim 1, wherein said distributor part consists of a cone or the frustum of a cone and where the horizontal cross section of the cone exhibits an arbitrary curve, the upper edge of the cone being provided with a flange or a collar.

10. A power plant according to claim 1, wherein said distributor is arranged along the direction of inflow of a fuel introduced into the bed from a fuel feed nozzle with the mid-portion at a variable distance, in the horizontal direction, from said nozzle.

11. A power plant according to claim 1, wherein said distributor is arranged at the tubes in the bed by means of holders in the form of clamps or loops or similar means.

12. A power plant according to claim 1, wherein said at least one nozzle for extra fluidization air is arranged close to said distributor.

13. A power plant according to claim 1, wherein said material in said distributor consists of one of steel, a steel alloy, a ceramic, or a combination of any of these materials.

14. A power plant according to claim 1, wherein the material in said distributor is cooled.

15. A power plant comprising a combustor containing a fluidized bed together with combustible gaseous and particulate material, tubes located in the combustor for steam generation, a plurality of nozzles for supplying fluidization air which fluidizes the material in the bed and fuel feed nozzles for feeding fuel to the bed; and at least one distributor adapted to spread fuel which, during combustion in the plant, rises upwards in the form of bubbles containing fuel gas, fuel particles and fluidization air;

said distributor being arranged at the upper limit of the fluidized bed;

said distributor including at least one elongated, wing-like member or a cone, which member or cone, starting from a lowest point, exhibit outwardly and upwardly inclined surfaces and wherein the elongation of each member outwards and upwards is greater than the width thereof.

16. A power plant according to claim 15, wherein said distributor is designed with two diametrically opposite wing-like members.

17. A power plant according to claim 15, wherein said wing-like members of the distributor in a cross section exhibit a v-shape or a curved surface and have opening which face downwards.

18. A power plant according to claim 15, wherein said wing-like members in a cross section exhibit an inverted U-shape.

19. A power plant according to claim 15, wherein said distributor is arranged at the tubes in the bed by means of holders.

20. A power plant according to claim 15, wherein the material in said distributor consists of steel or a steel alloy or a ceramic or a combination of any of these materials.

21. A power plant comprising a combustor containing a fluidized bed together with combustible gaseous and particulate material, tubes located in the combustor for steam generation, a plurality of nozzles for supplying fluidized air which fluidizes the material in the bed, and fuel feed nozzles for feeding fuel to said bed, and at least one distributor means positioned in said combustor and including at least one of:

(1) a first distributor device arranged in said bed above a fuel nozzle for spreading throughout the bed bubbles which are formed during combustion and rise upwardly; and (2) a second distributor device arranged at about the upper limit of said fluidized bed, for spreading fuel which has risen upwardly in the form of bubbles;

said first distributor device including one elongate member formed with at least one obliquely upwardly inclined surface, as viewed from a horizontal plane, said upwardly-inclined surface being arranged such that said bubbles are directed outwardly along the obliquely upwardly-inclined surface and are released evenly distributed in the bed while rising upwardly; and said second distributor device including one elongated, wing-like member or a cone, which member or cone, starting from a lowest point exhibits outwardly and upwardly inclined surfaces wherein the elongation of each member outwards and upwards is greater than the width thereof.

22. A power plant according to claim 21 wherein said elongate member forms at least one wing-like member or at least a fraction of a cone.

* * * * *